US006098919A

United States Patent [19]

Lewis

[11] Patent Number: 6,098,919

[45] Date of Patent: Aug. 8, 2000

[54] DRAG-REDUCING HUB AND SUPPORT ARM ASSEMBLIES FOR ROLL GOODS DISPENSER

[76] Inventor: Richard Paul Lewis, 3429 Woodrun Trail, Marietta, Ga. 30062

[21] Appl. No.: 09/000,507

[22] Filed: Dec. 30, 1997

Related U.S. Application Data

[63] Continuation of application No. 09/000,507, Dec. 30, 1997.

[51] Int. Cl.[7] ..... B65H 16/06; B65H 18/04

[52] U.S. Cl. ..... 242/596.3; 242/596.7

[58] Field of Search ..... 242/596.3, 596.7, 242/578.3

[56] References Cited

U.S. PATENT DOCUMENTS

| | | | |
|---|---|---|---|
| 383,911 | 6/1888 | Raymond | 221/71 |
| 489,787 | 1/1893 | Bowen . | |
| 786,741 | 4/1905 | Erwin et al. | 221/71 |
| 906,518 | 12/1908 | Elder | 312/34.8 |
| 1,793,165 | 2/1931 | Eckmann | 221/25 |
| 2,050,874 | 8/1936 | Barenyi | 242/596.7 X |
| 2,135,767 | 11/1938 | Price et al. | 312/39 |
| 2,146,038 | 2/1939 | West | 242/596.3 X |
| 2,206,951 | 7/1940 | Grunwald | 225/10 |
| 2,369,851 | 2/1945 | Price | 312/34.19 |
| 2,612,425 | 9/1952 | Jacobson | 312/39 |
| 2,726,823 | 12/1955 | Jespersen | 242/596.3 X |
| 2,809,790 | 10/1957 | Kirchel | 242/596.3 |
| 2,908,449 | 10/1959 | Bolger . | |
| 3,566,732 | 3/1971 | Hasten | 83/205 |
| 3,647,158 | 3/1972 | Feder | 242/596.3 X |
| 3,843,218 | 10/1974 | Krueger et al. | 312/38 |
| 3,991,923 | 11/1976 | Nishikawa | 225/20 |
| 4,009,627 | 3/1977 | High | 83/205 |
| 4,105,168 | 8/1978 | Rutherford | 242/55.2 |
| 4,974,783 | 12/1990 | Campbell | 242/596.3 X |
| 5,161,723 | 11/1992 | Wirtz-Odenthal | 225/14 |

FOREIGN PATENT DOCUMENTS

| | | |
|---|---|---|
| 930337 | 7/1973 | Canada . |
| 0 483 749 A1 | 10/1991 | European Pat. Off. . |
| 258383 | 9/1926 | United Kingdom . |
| 2028765 | 3/1980 | United Kingdom . |

OTHER PUBLICATIONS

Copy of PCT Search Report US 98/26838, completed Mar. 24, 1999.

*Primary Examiner*—John Q. Nguyen

[57] ABSTRACT

A hub assembly for use in a dispenser for a roll of sheet material having a core, which hub assembly includes a mounting plate having a first side and a second side, a hub attached to the first side of the mounting plate, and a bracket attached to the second side of the mounting plate for pivotally mounting the hub assembly on a support. If desired, the hub may be freely rotatable. Also provided is a hub support assembly for use in a dispenser for a roll of sheet material having a core. The hub support assembly includes a hub assembly and a support arm, in which the hub assembly may be the hub assembly just described. The support arm has a first end and a second end, in which the first end is adapted to be pivotally mounted on a support, and the first end has a tensioning device to apply a retaining force to the roll and to permit compensation for varying product widths. The hub assembly is pivotally mounted to the second end of the support arm by the bracket attached to the second side of the hub assembly mounting plate, thereby assuring that the roll retaining force is applied axially through the center core of the roll without applying drag on the roll. Again, the hub may be freely rotatable. By way of example, the tensioning device may be a spring. Additional embodiments and variations also are described.

17 Claims, 7 Drawing Sheets

DRAG-REDUCING HUB AND SUPPORT ARM ASSEMBLIES FOR ROLL GOODS DISPENSER

This is a continuing application of No. 09/000,507, filed on Dec. 30, 1997.

BACKGROUND OF THE INVENTION

The present invention relates to a dispenser for commercial and consumer roll form products such as, for example, such absorbent paper products as toilet tissue and paper towels.

Commercial and consumer absorbent products such as shop towels, nonwoven fabrics, wipers, toilet tissue and paper towels often are distributed and dispensed in roll format. Most products in this format include a cylindrical core at the center of the roll. Typically, the product is wrapped about the core and most roll format product dispensers require this core to function properly. The core usually is some type of cardboard or plastic tube to which the product is glued so that the product does not separate from the core. Product normally is loaded by mounting the roll on opposing pegs or hubs which penetrate the hollow space within the core to only a limited extent.

While conventional dispensers often allow for variations in product widths, such variations may result in increased or unanticipated drag on the product. Accordingly, there is a need for a means of reducing or eliminating such increased or unanticipated drag.

SUMMARY OF THE INVENTION

The present invention addresses some of the difficulties and problems discussed above by providing a hub assembly for use in a dispenser for a roll of sheet material having a core. The hub assembly includes a mounting plate having a first side and a second side, a hub attached to the first side of the mounting plate, and a bracket attached to the second side of the mounting plate for pivotally mounting the hub assembly on a support. If desired, the hub may be freely rotatable.

The present invention also provides a hub support assembly for use in a dispenser for a roll of sheet material having a core. The hub support assembly includes a hub assembly and a support arm. The hub assembly includes a mounting plate having a first side and a second side, a hub attached to the first side of the mounting plate, and a bracket attached to the second side of the mounting plate. The bracket is adapted for pivotally mounting the hub assembly on the support arm. If desired, the hub may be freely rotatable.

The support arm has a first end and a second end, in which the first end is adapted to be pivotally mounted on a support, and the first end has a tensioning means to apply a retaining force to the roll and to permit compensation for varying product widths. The hub assembly is pivotally mounted to the second end of the support arm by means of the bracket on the second side of the mounting plate, thereby assuring that the roll retaining force is applied axially through the center core of the roll without applying drag on the roll. By way of example, the tensioning means may be a spring.

The present invention further provides a roll retaining assembly for use in a dispenser for a roll of sheet material having a core. The roll retaining assembly includes a first hub assembly, a support arm, and a second hub assembly. The first hub assembly includes a mounting plate having a first side and a second side. A first hub is attached to the first side of the mounting plate and a bracket is attached to the second side of the mounting plate. The bracket is adapted for pivotally mounting the first hub assembly on the support arm.

The support arm has a first end and a second end. The first end is adapted to be pivotally mounted on a support, and the first end has a tensioning means to apply a retaining force to the roll and to permit compensation for varying product widths. The first hub assembly is pivotally mounted to the second end of the support arm by means of the hub assembly bracket, thereby assuring that the roll retaining force is applied axially through the center core of the roll without increasing drag on the roll.

Finally, the second hub assembly coaxially opposes the first hub. The second hub assembly includes a mounting plate having a first side and a second side. A second hub is attached to the first side of the mounting plate and the second side is attached to a support, either directly or through any type of coupling device known to those having ordinary skill in the art. Either or both of the first hub and the second hub may be freely rotatable.

A number of variations are contemplated by the present invention. For example, the second hub assembly may be attached to an inside surface of the dispenser or to an integral part thereof. As another example, the second hub assembly may be attached to a rigid bracket attached to or an integral part of an inside surface of the dispenser. As a further example, the first end of the support arm may be attached to an inside surface of the dispenser or to an integral part thereof. As still another example, the first end of the support arm may be attached to a rigid bracket attached to or an integral part of an inside surface of the dispenser. As yet another example, the roll retaining assembly may further include a rigid bracket having a first end and a second end, in which the second hub assembly is attached to the second end of the rigid bracket by means of a rigid extension and the first end of the support arm is attached to the first end of the rigid bracket. The rigid extension may be an integral part of one or more inside surfaces of the dispenser.

If desired, the second hub assembly may be attached to a second support arm. The second support arm may have a first end and a second end as described for the support arm to which the first hub assembly is attached. That is, the first end of the second support arm may be adapted to be pivotally mounted on a support, and the first end may have a tensioning means to apply a retaining force to the roll and to permit compensation for varying product widths. The second hub assembly may include a bracket attached to the second side of the mounting plate to permit pivotally mounting the second hub assembly to the second end of the second support arm. Thus, the second hub assembly and the second support arm may be a mirror image of the first hub assembly and its support arm. Such an arrangement would aid in centering the roll of product in the dispenser over a dispenser opening.

DETAILED DESCRIPTION OF THE INVENTION

Figure 1:
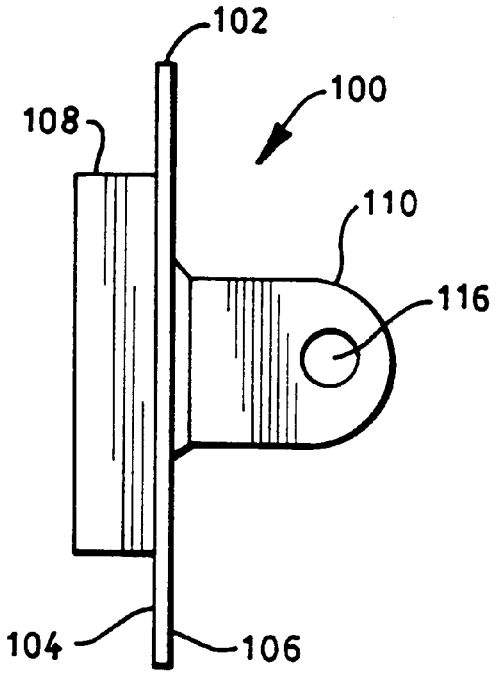
FIG. 1 is a side view of one embodiment of a hub assembly of the present invention.
Figure 2:
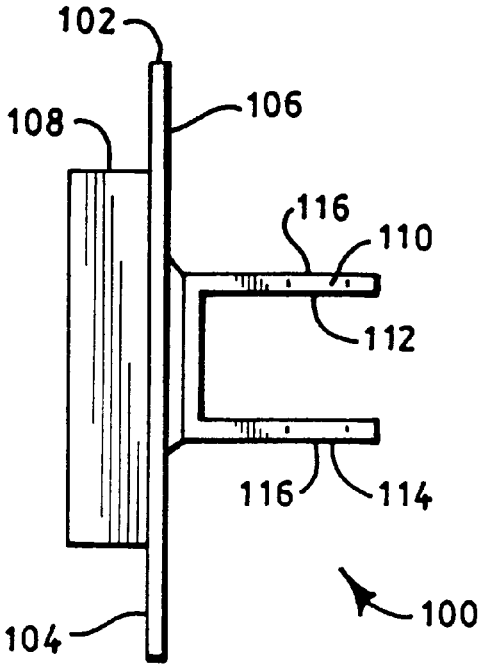
FIG. 2 is a top view of the hub assembly of FIG. 1.

Referring now to the drawings in which like reference numerals refer to like parts, there is shown in FIGS. 1 and 2 one embodiment of a hub assembly of the present invention. The hub assembly 100 includes a mounting plate 102 having a first side 104 and a second side 106. A hub 108 is attached to the first side 104 of the mounting plate 102. If desired, the hub 108 may be freely rotatable. The hub 108 may be a solid cylinder or an annular ring having a diameter which is slightly smaller than the core of a roll of product. The mounting plate 102 has a bracket 110 attached to the second side 106 of the mounting plate 102 for pivotally mounting the hub assembly on a support (not shown). In the embodiment shown in FIGS. 1 and 2, the bracket 110 is U-shaped, having side arms 112 and 114. A support (not shown) to which the hub assembly may be attached would be of a size and shape to fit between the side arms 112 and 114 of the bracket 110. The bracket 110 may be fastened to the support by means of a bolt, screw, pin, or similar device (not shown) inserted through holes 116 in the side arms 112 and 114 and a corresponding hole in the support. The bolt may be tightened sufficiently to hold the hub assembly 100 in place while allowing the hub assembly 110 to pivot around the bolt. Thus, the hub assembly 110 is capable of being pivotally mounted on the support.

Figure 3:
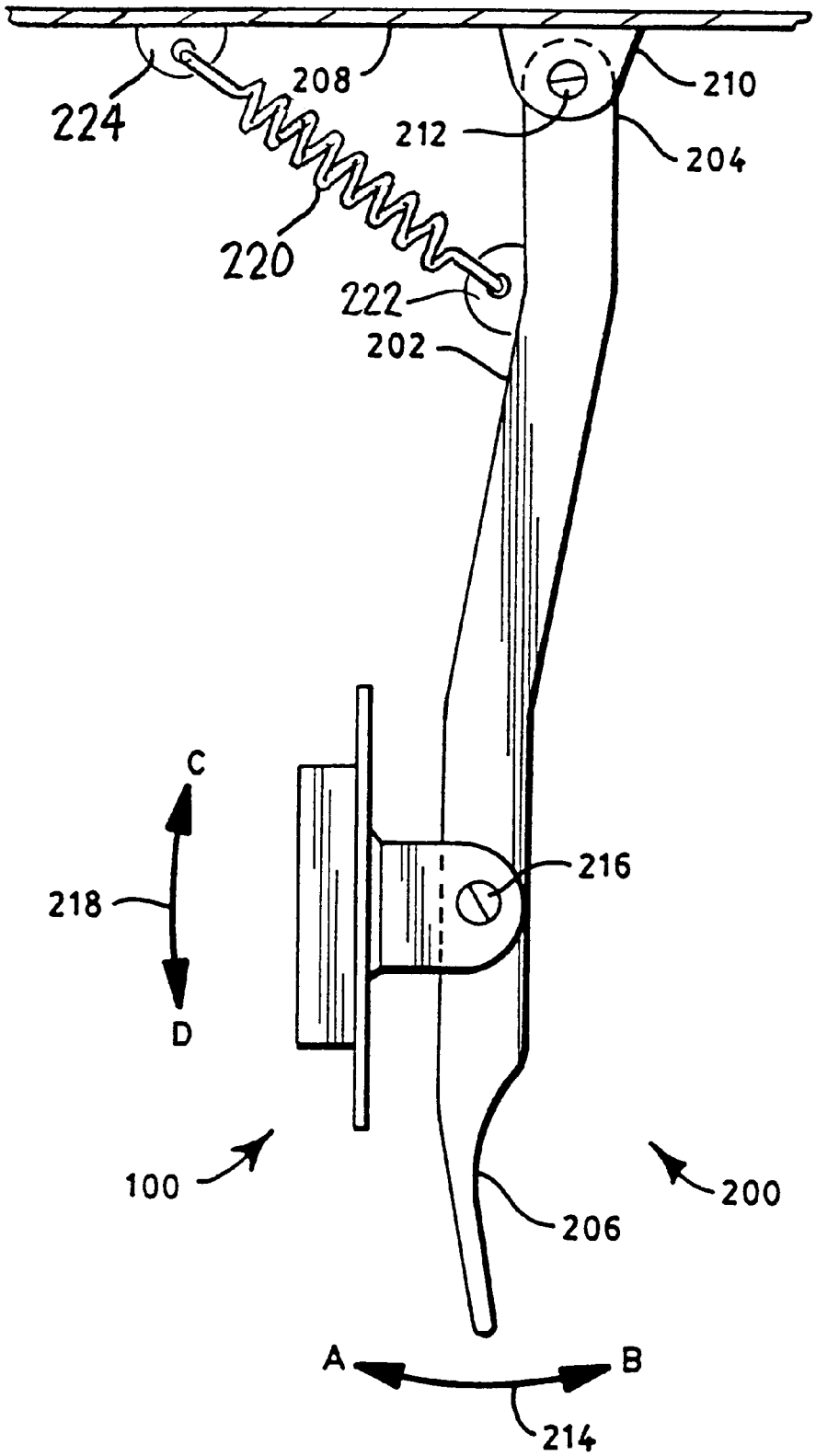
FIG. 3 is a side view of one embodiment of a hub support assembly of the present invention which includes the hub assembly of FIGS. 1 and 2.

An embodiment of a hub support assembly of the present invention is shown in FIG. 3. The hub support assembly 200 includes a hub assembly 100 and a support arm 202 having a first end 204 and a second end 206. The first end 204 is mounted on an interior surface 208 of a dispenser (not shown) by means of a U-shaped bracket 210 which is mounted on the interior surface 208 of the dispenser or an integral part thereof. The support arm 202 is held in place by a bolt 212 which passes through matching holes (not shown) in the bracket 210 and the first end 204 of the support arm 202. Thus, bolt 212 represents an axis about which the support arm 202 is free to pivot; the movement of the support arm 202 is shown by arrow 214, with direction A of the arrow 214 representing movement toward a roll of product to be dispensed (not shown) and direction B representing movement away from the roll of product. The first end has a tensioning means to apply tension on the support arm 202 in the direction of the roll of product. Such tension means, for example, may be a spring 220 attached to a bracket 222 on the first end 204 and a bracket 224 attached to the interior surface 208 to apply tension in the direction A of the arrow 214; movement of the support arm 202 may be limited by stops (not shown) provided by the shape of the first end 204 of the support arm 202 or by stops present on the interior surface 208 of the dispenser. This and other tension means are, of course, well known to those having ordinary skill in the art. The hub assembly 100 of FIGS. 1 and 2 is mounted near the second end 206 of the support arm 202. The hub assembly 100 is held in place by a bolt 216 which passes through holes 116 of bracket 110 (FIGS. 1 and 2) and a matching hole (not shown) in support arm 202. Accordingly, bolt 216 represents an axis about which the hub assembly 100 is free to pivot; the movement of the hub assembly 100 is shown by arrow 218, with direction C of the arrow 218 representing movement toward the interior surface 208 of the dispenser and direction D representing movement away from the interior surface 208.

Figure 4:
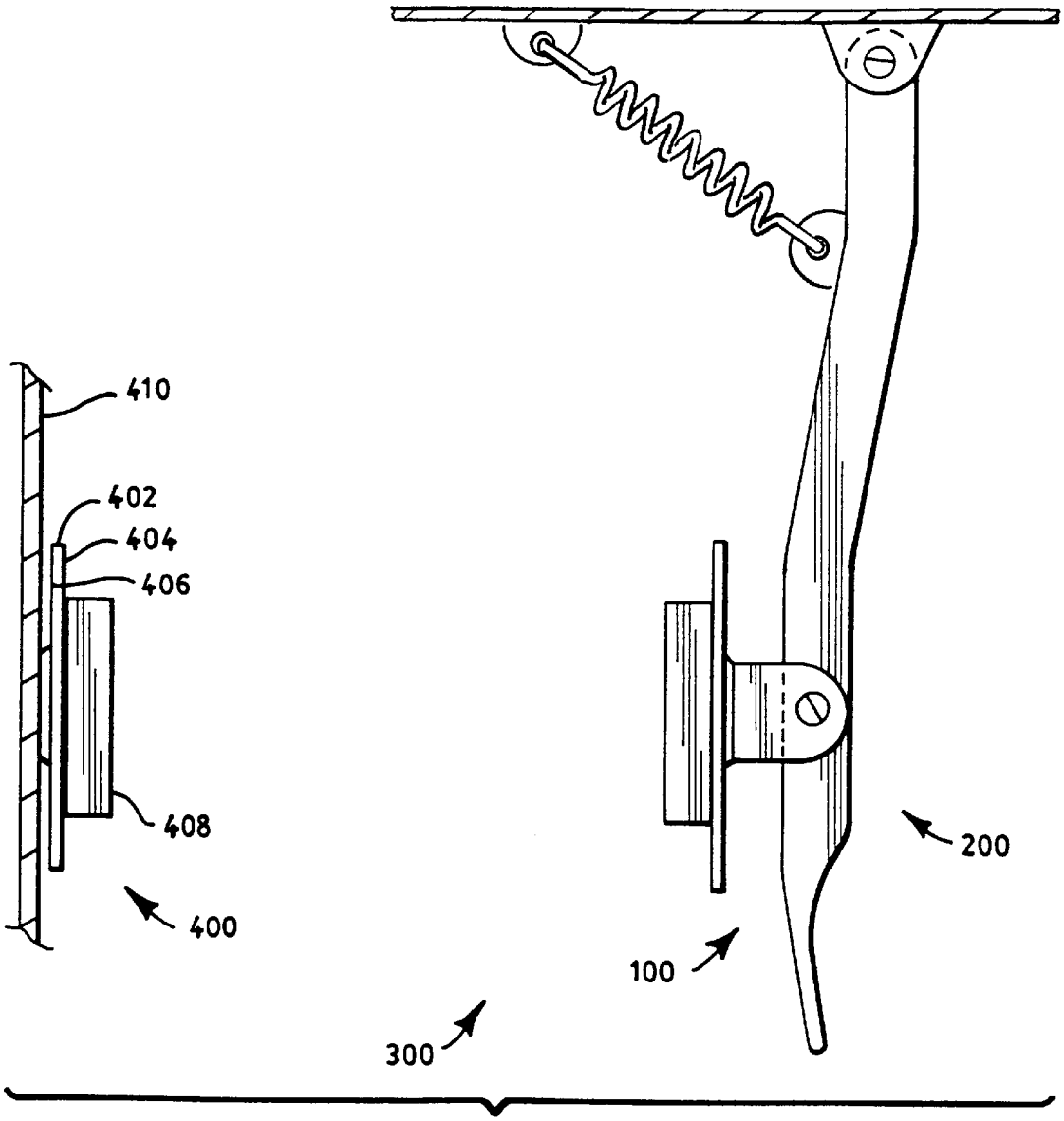
FIG. 4 is a side view of a roll retaining assembly of the present invention which includes the hub support assembly of FIG. 3.

FIG. 4 shows one embodiment of a roll retaining assembly of the present invention for use in a dispenser for a roll of sheet material having a core. The roll retaining assembly 300 includes the hub support assembly 200 of FIG. 3, which includes the hub assembly 100 of FIGS. 1 and 2 and the support arm 202 of FIG. 3, and a second hub assembly 400. The second hub assembly 400 has a mounting plate 402 which has a first side 404 and a second side 406. A hub 408 is attached to the first side of the mounting plate 402. If desired, the hub 408 also may be freely rotatable. The second hub assembly 400 is mounted on an interior surface 410 of the dispenser (not shown). The second hub assembly opposes and is coaxial with the hub assembly 100 which is part of the hub support assembly 200. Because of the characteristics of the hub support assembly described above, a roll retaining force is applied axially through the center core of the roll without increasing drag on the roll.

A number of variations are contemplated by the present invention. For example, the second hub assembly may be attached to an inside surface of the dispenser or to an integral part thereof. As another example, the second hub assembly may be attached to a rigid bracket attached to or an integral part of an inside surface of the dispenser. As a further example, the first end of the support arm may be attached to an inside surface of the dispenser or to an integral part thereof. As still another example, the first end of the support arm may be attached to a rigid bracket attached to or an integral part of an inside surface of the dispenser. As yet another example, the roll retaining assembly may further include a rigid bracket having a first end and a second end, in which the second hub assembly is attached to the second end of the rigid bracket by means of a rigid extension and the first end of the support arm is attached to the first end of the rigid bracket. The rigid extension may be an integral part of one or more inside surfaces of the dispenser.

Figure 5:
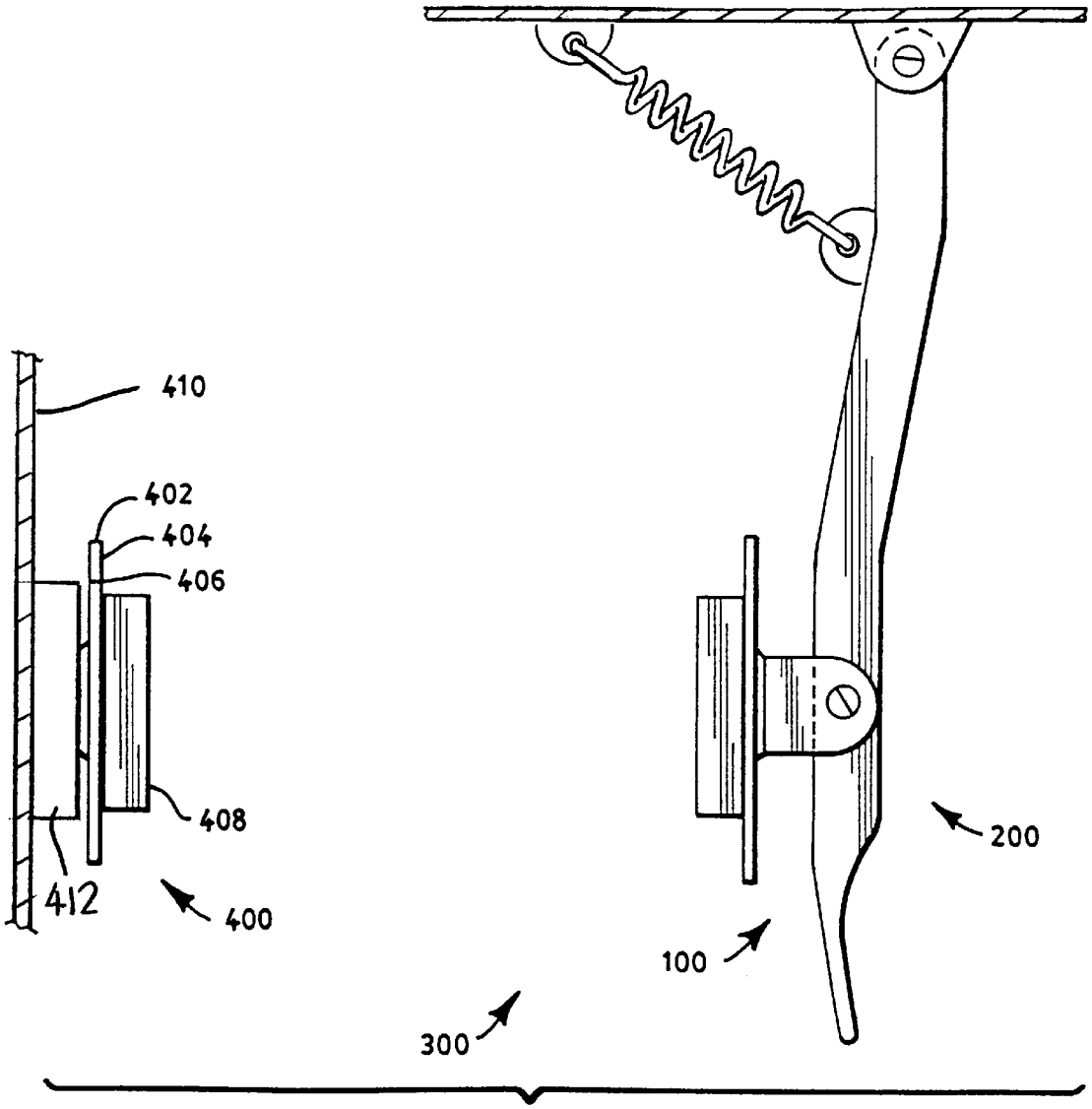
FIGS. 5–8 are side views of various embodiments of the roll retaining assembly of FIG. 4.

Some of the variations discussed above are shown by FIGS. 5–8. FIG. 5 shows another embodiment of a roll retaining assembly of the present invention for use in a dispenser for a roll of sheet material having a core. The roll retaining assembly 300 includes the hub support assembly 200 of FIG. 3, which includes the hub assembly 100 of FIGS. 1 and 2 and the support arm 202 of FIG. 3, and the second hub assembly 400 of FIG. 4. In this instance, the second hub assembly 400 is mounted on a bracket 412 which, in turn, is mounted on or an integral part of interior surface 410 of the dispenser (not shown). The second hub assembly opposes and is coaxial with the hub assembly 100 which is part of the hub support assembly 200. Because of the characteristics of the hub support assembly described above, a roll retaining force is applied axially through the center core of the roll without increasing drag on the roll.

Figure 6:
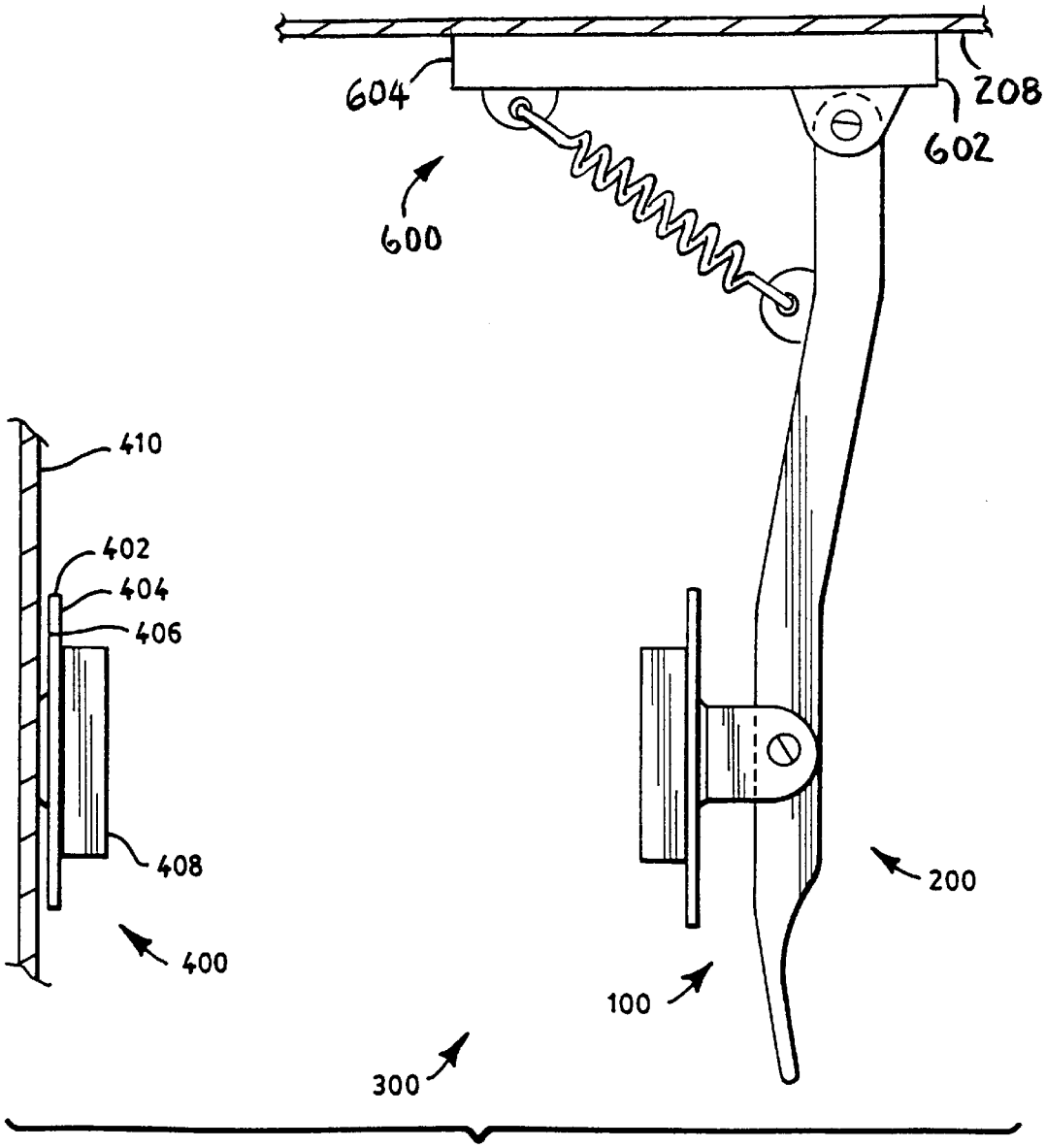

In FIG. 6, the roll retaining assembly 300 includes the hub support assembly 200 of FIG. 3, which includes the hub assembly 100 of FIGS. 1 and 2 and the support arm 202 of FIG. 3, and the second hub assembly 400 of FIG. 4. The first end 204 of the support arm 202 is mounted on a first end 602 of a rigid bracket 600 which is attached to or an integral part of an interior surface 208 of a dispenser (not shown). The spring tensioning means 220 is attached to a second end 604 of the rigid bracket 600. As with the embodiments illustrated by previous figures, a roll retaining force is applied axially through the center core of the roll without increasing drag on the roll.

Figure 7:
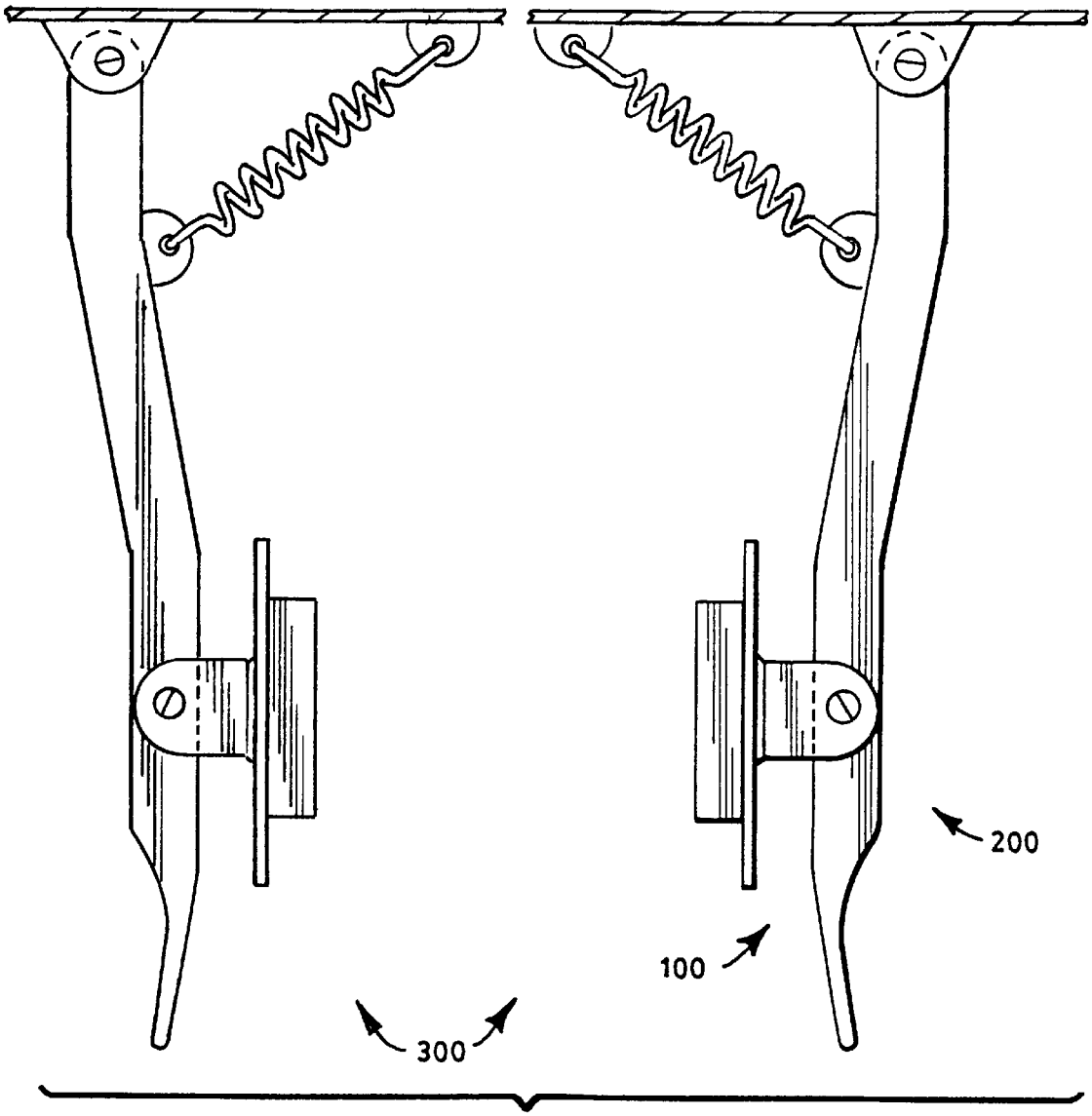

The embodiment shown in FIG. 7 is similar to that of FIG. 4, except that the second hub assembly 400 is part of a second hub support assembly. Thus, the embodiment consists of two hub support assemblies 300 which face each other, thereby applying a roll retaining force axially through the center core of the roll without increasing drag on the roll.

Figure 8:
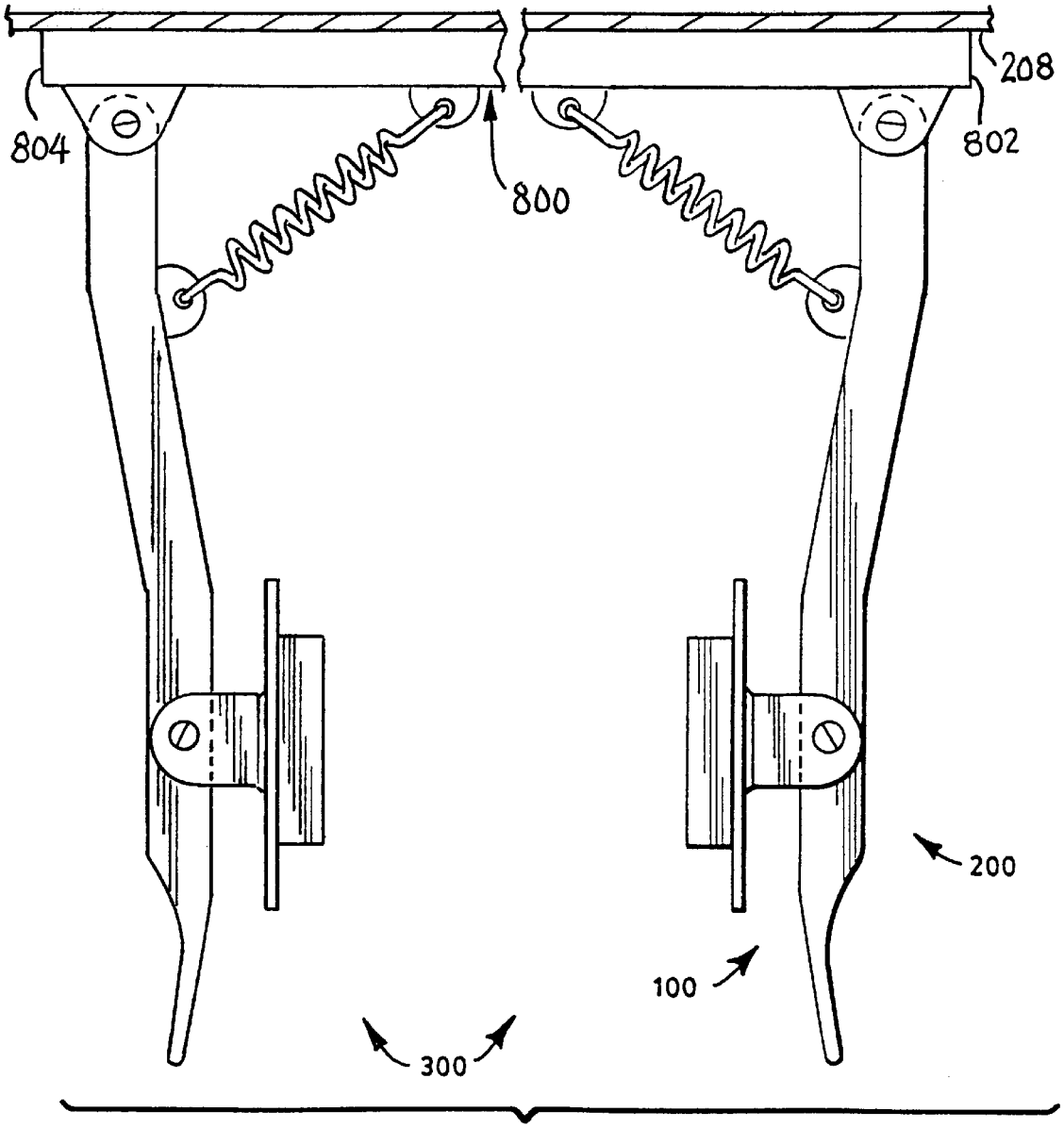

The embodiment shown in FIG. 8 is similar to that of FIG. 7, except that the first hub support assembly is attached to a first end 802 of a rigid bracket 800 which is attached to or an integral part of interior surface 208 of a dispenser (not shown), and the second hub support assembly is attached to a second end 804 of the rigid bracket 800. By means of the facing hub support assemblies, a roll retaining force is applied axially through the center core of the roll without increasing drag on the roll.

As used herein, the term "an integral part thereof" has reference to, for example, a protrusion, bracket, or other suitable three-dimensional shape shaped or molded as an integral or nonseparable part of one or more inside surfaces of the dispenser.

If desired, the second hub assembly may be attached to a second support arm. The second support arm may have a first end and a second end as described for the support arm to which the first hub assembly is attached. That is, the first end of the second support arm may be adapted to be pivotally mounted on a support, and the first end may have a tensioning means to apply a retaining force to the roll and to permit compensation for varying product widths. The second hub assembly may include a bracket attached to the second side of the mounting plate to permit pivotally mounting the second hub assembly to the second end of the second support arm. Thus, the second hub assembly and the second support arm may be a mirror image of the first hub assembly and its support arm. Such an arrangement would aid in centering the roll of product in the dispenser over a dispenser opening.

While the specification has been described in detail with respect to specific embodiments thereof, it will be appreciated by those skilled in the art, upon attaining an understanding of the foregoing, may readily conceive of alterations to, variations of, and equivalents to these embodiments. Accordingly, the scope of the present invention should be assessed as that of the appended claims and any equivalents thereto.

What is claimed is:

1. A hub support assembly for use in a dispenser for a roll of sheet material having a core, which hub support assembly comprises:

a hub assembly;

and a support arm having a first end and a second end; in which the hub assembly comprises a mounting plate having a first side and a second side, a hub attached to the first side, and a bracket attached to the second side, which bracket is structured to pivotally mount the hub assembly on the support arm to permit compensation for varying roll widths;

the first end of the support arm is structured to be pivotally mounted on a support and has a tensioning means to apply an axially directed retaining force to the roll for cooperating with said pivotally mounted hub assembly to permit compensation for varying roll widths;

and the hub assembly is pivotally mounted to the second end of the support arm by means of the hub assembly bracket and is structured to assure that the roll retaining force is applied axially through the center core of the roll without applying drag on the roll.

2. The hub support assembly of claim 1, in which the hub is freely rotatable.

3. The hub support assembly of claim 1, in which the tensioning means is a spring.

4. A roll retaining assembly for use in a dispenser for a roll of sheet material having a core, which roll retaining assembly comprises:

a first hub assembly;

a support arm;

and a second hub assembly; in which the first hub assembly comprises a mounting plate having a first side and a second side, a first hub attached to the first side, the mounting plate, and a bracket attached to the second side of the mounting, the bracket being structured for pivotally mounting the hub assembly on the support arm plate to permit compensation for varying roll widths;

the support arm has a first end and a second end, the first end is structured for pivotally mounting the support arm on a support, and the first end has a tensioning means to apply an axially directed retaining force to the roll for cooperating with said pivotally mounted hub assembly to permit compensation for varying roll widths;

the first hub assembly is pivotally mounted to the second end of the support arm by means of the bracket attached to the second side of the mounting plate of the first hub assembly and is structured to assure that the roll retaining force is applied axially through the center core of the roll without increasing drag on the roll;

the second hub assembly comprises a mounting plate having a first side and a second side and a second hub attached to the first side of the mounting plate; and the second hub assembly is structured for mounting on a support coaxially with and in opposition to the first hub assembly.

5. The roll retaining assembly of claim 4, in which the first end of the support arm is attached to a rigid bracket which is attached to, or an integral part of, an inside surface of the dispenser.

6. The roll retaining assembly of claim 4 which further comprises a rigid bracket having a first end and a second end, in which the second hub assembly is attached to the first end of the rigid bracket by means of a rigid extension and the first end of the support arm is attached to the second end of the rigid bracket.

7. The roll retaining assembly of claim 4, in which the first hub and the second hub are freely rotatable.

8. The roll retaining assembly of claim 4, in which the second hub assembly is attached to an inside surface of the dispenser or to an integral part thereof.

9. The roll retaining assembly of claim 4, in which the second hub assembly is attached to a rigid bracket which is attached to, or an integral part of, an inside surface of the dispenser.

10. The roll retaining assembly of claim 4, in which the first end of the support arm is attached to an inside surface of the dispenser or to an integral part thereof.

11. A roll retaining assembly for use in a dispenser for a roll of sheet metal having a core, which roll retaining assembly comprises:

a first hub assembly;

a first support arm;

a second hub assembly;

and a second support arm;

in which the first hub assembly comprises a mounting plate having a first side and a second side, a first hub is attached to the first side of the mounting plate, and a bracket attached to the second side of the mounting plate, the bracket being structured for pivotally mounting the hub assembly on the first support arm to permit compensation for varying roll widths;

the first support arm has a first end and a second end, the first end is structured for pivotally mounting the first support arm on a support, and the first end has a tensioning means to apply an axially directed retaining force to the roll for cooperating with said pivotally mounted hub assembly to permit compensation for varying roll width;

the first hub assembly is pivotally mounted to the second end of the first support arm by means of the bracket attached to the second side of the mounting plate of the first hub assembly and is structured to assure that the roll retaining force is applied axially through the center core of the roll without increasing drag on the roll;

the second hub assembly comprises a mounting plate having a first side and a second side, a second hub is attached to the first side of the mounting plate, and a bracket attached to the second side of the mounting plate, the bracket being structured for pivotally mounting the hub second assembly on the second support arm;

the second support arm has a first end and a second end, the first end is structured for pivotally mounting the second support arm on a support, and the first end has a tensioning means to apply a retaining force to the roll and to permit compensation for varying widths;

the second hub assembly is pivotally mounted to the second end of the second support arm by means of the bracket attached to the second side of the mounting plate of the second hub assembly and is structured to assure that the roll retaining force is applied axially through the center core of the roll without increasing drag on the roll; and the second hub assembly is structured to be essentially coaxial with and oppose the first hub assembly.

12. The roll retaining assembly of claim 11, in which the first end of the second support arm is attached to a rigid bracket attached to an inside surface of the dispenser or to an integral part thereof.

13. The roll retaining assembly of claim 11, in which the first end of the first support arm is attached to a first end of a rigid bracket attached to an inside surface of the dispenser and the first end of the second support arm is attached to a second end of the rigid bracket.

14. The roll retaining assembly of claim 11, in which the first hub and the second hub are freely rotatable.

15. The roll retaining assembly of claim 11, in which the first end of the first support arm is attached to an inside surface of the dispenser or to an integral part thereof.

16. The roll retaining assembly of claim 11, in which the first end of the second support arm is attached to an inside surface of the dispenser or to an integral part thereof.

17. The roll retaining assembly of claim 11, in which the first end of the first support arm is attached to a rigid bracket attached to or an integral part of an inside surface of the dispenser.

* * * * *